US005901975A

United States Patent [19]

Phipps

[11] Patent Number: 5,901,975

[45] Date of Patent: May 11, 1999

[54] VERTICALLY FLEXIBLE SNOWBOARD BINDING

[75] Inventor: Eric Todd Phipps, Colorado Springs, Colo.

[73] Assignees: Eric T. Phipps; K. Phipps, both of Denver, Colo.

[21] Appl. No.: 08/819,788

[22] Filed: Mar. 18, 1997

[51] Int. Cl.[6] ..... A63C 9/08

[52] U.S. Cl. ..... 280/618; 280/14.2

[58] Field of Search ..... 280/607, 617, 280/618, 614, 636, 623, 611, 14.2

[56] References Cited

U.S. PATENT DOCUMENTS

| | | | |
|---|---|---|---|
| 2,564,420 | 8/1951 | Brown | 280/14.2 |
| 2,593,974 | 4/1952 | Brown | 280/14.2 |
| 3,139,287 | 6/1964 | Annis | 280/21.1 X |
| 5,028,068 | 7/1991 | Donovan | 280/618 |
| 5,044,656 | 9/1991 | Peyre | 280/618 |
| 5,054,807 | 10/1991 | Fauvet | 280/607 |
| 5,066,036 | 11/1991 | Broughton | 280/618 X |
| 5,085,455 | 2/1992 | Bogner et al. | 280/618 |
| 5,090,722 | 2/1992 | Ritchie et al. | 280/607 |
| 5,143,396 | 9/1992 | Shaanan et al. | 280/607 |
| 5,172,924 | 12/1992 | Barci | 280/14.2 |
| 5,236,216 | 8/1993 | Ratzek | 280/607 |
| 5,312,258 | 5/1994 | Giorgio | 434/253 |
| 5,409,244 | 4/1995 | Young | 280/14.2 |
| 5,435,080 | 7/1995 | Meiselman | 36/117 |
| 5,480,176 | 1/1996 | Sims | 280/618 |
| 5,499,837 | 3/1996 | Hale et al. | 280/607 |
| 5,503,900 | 4/1996 | Fletcher | 428/160 |
| 5,520,406 | 5/1996 | Anderson et al. | 280/624 |
| 5,558,355 | 9/1996 | Henry | 280/624 |
| 5,564,719 | 10/1996 | Kisselmann | 280/14.2 |

OTHER PUBLICATIONS

"Work?: SkateStyle Snowboard Bindings", http://www.et-.byu.edu/~mansure/skatestyle/work.html, Dec. 17, 1996.

"Bomber 'Trench Digger'", http://ourworld.compuserve-.com/homepages/bomberl/, Jan. 14, 1997.

"B.A.D. System", http://ourworld.compuserve.com/homep-ages/bomberl/badsyste.htm, Jan. 14, 1997.

"Excel Rotational Bindings", http://www.murrays.com/snow/excel_snow/excel.html, Jan. 14, 1997.

*Primary Examiner*—J. J. Swann
*Assistant Examiner*—Michael Mar
*Attorney, Agent, or Firm*—Linda Flewellen Gould

[57] ABSTRACT

A snowboard rider wears boots that fit into manually releasable bindings which are attached to the top surface of the snowboard, analogous to bindings on alpine skis. Generally, the snowboard bindings are aligned at approximately right angles to the longitudinal axis of the board, with one foot nearer to the front of the board, and the other foot nearer to the tail of the board. In a typical binding design, each boot is rigidly held in a fixed position with respect to the snowboard with no movement of the foot being possible absent corresponding movement of the snowboard. The snowboard binding described herein permits the rider to enjoy the flexibility of toe-to-heel movement, while providing for a simple method of restraining that method for terrains in which flexibility would be detrimental. Each binding consists of a footplate onto which the boot is strapped, a fulcrum attached to the bottom of the footplate, and a fulcrum receptacle mounted on top of the snowboard. When the fulcrum is a rigid half circle with the flat edge attached to the bottom of the footplate, a fulcrum pin is inserted through the fulcrum receptacle and through a hole formed in the fulcrum to hold the fulcrum in place with respect to the snowboard, while allowing toe-to-heel motion around the axis of the fulcrum. A separate locking pin may be removably inserted into a locking pin receptacle mounted on the bottom of the footplate and through an adjacent hole formed in the fulcrum receptacle to inhibit vertical flexibility of the footplate when desired.

7 Claims, 4 Drawing Sheets

VERTICALLY FLEXIBLE SNOWBOARD BINDING

1.0 BACKGROUND OF THE INVENTION

1.1 Related Filings

This application is related to Document Disclosure 409711 filed on Dec. 20, 1996.

1.2 Technical Field

This invention pertains to a specialized binding for snowboards and similar sports equipment which allows for flexibility in toe-to-heel movement as a rider maneuvers the board.

1.3 Background Art

In a number of relatively new sports, both of the participant's feet are affixed to the same gliding board. While this configuration includes a number of different boards, including snowboards, monoskis, and wakeboards, the term "snowboard" will be used throughout this specification, it being understood that the invention claimed herein may apply to any such gliding board.

The snowboard rider wears boots that fit into manually releasable bindings which are attached to the top surface of the snowboard, analogous to bindings on alpine skis. Generally, the snowboard bindings are aligned at approximately right angles to the longitudinal axis of the board, with one foot nearer to the front of the board, and the other foot nearer to the tail of the board.

As snowboarding has become a popular alpine sport, a variety of different binding designs have been developed. For example, U.S. Pat. No. 5,143,396 to Shaanan et al., U.S. Pat. No. 5,172,924 to Barci, U.S. Pat. No. 5,480,176 to Sims, and U.S. Pat. No. 5,409,244 to Young each describe specialized bindings for snowboards. While the boot mounts directly on the snowboard in Sims and Young, many snowboard binding designs include a separate footplate mounted between the snowboard and the boot. U.S. Pat. No. 5,520,406 to Anderson et al. specially designs the footplate to avoid cavities that can accumulate ice and snow.

Innovative snowboard bindings have been designed to accommodate special problems associated with snowboarding. For example, because both feet are mounted on one board, when the rider looses his balance to such an extent that one boot disengages from the board, extreme stress results to the leg which remains bound to the board, possibly causing serious injury to bones or ligaments. To remedy this concern, a variety of binding designs have been created, each providing for the second boot to be automatically released when a first boot disengages. U.S. Pat. Nos. 5,054,807 to Fauvet, 5,564,719 to Kissel, and 5,085,455 to Bogner et al. are each examples of such designs.

Another known problem for snowboarders is the need to disengage one boot and use that foot to push the snowboard in an uphill setting, such as to get to and from a ski lift. To accommodate this need, snowboard bindings have been developed that allow for ease of entering into and disengaging one boot binding, such as U.S. Pat. No. 5,558,355 to Henry. U.S. Pat. No. 5,499,837 to Hale et al. further alleviates problems associated with pushing the snowboard with only one boot attached to the board by permitting easy rotation of the binding so that the boot remaining in the snowboard can be faced toward the front of the snowboard. Another novel approach to this issue is taught in U.S. Pat. No. 5,090,722 to Ritchie et al., providing for a temporary foot-gripping device between the two boot bindings.

While snowboard bindings are typically aligned at an angle to the longitudinal axis to the board, many of such bindings are in a fixed position. Thus, once such bindings have been attached to the board, the user has no method of adjusting the alignment even if a different orientation would be better suited to this user's style of maneuvering the board. To provide for more flexibility in aligning bindings, a number of specialized bindings have been developed, which allow for movement of the bindings to different orientations with respect to the longitudinal axis of the board, and then provide for locking the binding in its new position. Examples of such bindings are found in U.S. Pat. Nos. 5,028,068 to Donovan and 5,236,216 to Ratzek. Similarly, a binding advertised on the internet at http://www.murrays.com/snow/excel_snow/excel.html, known as "Excel Rotational Bindings", permits the user to adjust the back of the binding to a chosen angle, and to fasten the binding at that chosen angle.

As snowboarders increase in sophistication and skill, they frequently seek more flexibility in their board and bindings, to permit different types of turns and maneuvers. A binding with a double hinge mechanism is advertised on the internet at http://www.et.byu.edu/~mansure/skatestyle/work.html, which allows the rider to rotate his foot from side to side while riding the board. Similarly, U.S. Pat. No. 5,044,656 to Peyre describes a snowboard with a boardplate secured to the top of the snowboard, and a boot plate, connectable to the boot, with resilient tensioning devices connecting the two plates, to allow for movement in three directions within certain limits. An internet advertisement at http://ourworld.compuserve.com/homepages/bomber1/badsyste.htm describes a binding with elastomer bumpers between a footplate and the snowboard to cushion the rider and reduce vibrations.

While each of these bindings is useful for its intended purpose, none is suitable for providing flexibility in toe-to-heel movement as a rider maneuvers the board, while providing the rider with the ability to lock the boot and footplate in a fixed position when riding conditions make a rigid configuration preferable.

2.1 DISCLOSURE OF THE INVENTION

2.1 Summary of the Invention

An object of this invention is to provide a new and useful snowboard binding which allows for flexibility in toe-to-heel movement as a rider maneuvers the board.

Another object of this invention is to provide a method of alternating a snowboard binding between a flexible position in which toe-to-heel movement is permitted, and a rigid position in which toe-to-heel movement is inhibited.

Yet another object of this invention is to provide a snowboard binding which cushions the rider's foot against vibrations to allow the rider to have more control and balance, and thus a smoother ride.

When riding a snowboard, the rider's boots are held to the board by means of bindings. The bindings typically align the rider's feet at an angle to the longitudinal axis of the board, with one foot closer to the front of the board and the other foot closer to the tail of the board. While the bindings are permanently affixed to the top of the board, the rider's boots can be removably placed within those bindings, so that the boots are held in place on top of the snowboard when the bindings are strapped to the boots.

As snowboard riders become more adept at making the turns, twists, and jumps which are the goal of a proficient snowboarder, some flexibility in the position of the boots with respect to the board becomes useful. At the same time, rugged terrain will occasionally necessitate rigid positioning of the boots with respect to the board. Thus, it is useful to have a method of alternating between a flexible position in which toe-to-heel movement is allowed to execute particular maneuvers, and a rigid position in which toe-to-heel movement is inhibited to negotiate difficult terrain.

The snowboard binding claimed herein consists of a footplate mounted on a fulcrum which is placed within a fulcrum receptacle attached to the top of the snowboard. Straps suitable for removably attaching a snowboard boot to the footplate, similar to straps which are presently available in other snowboard binding designs, are attached to each footplate, allowing a single boot to be held in the binding. Each of the snowboard rider's boots can thus be removably attached to the top of adjacent footplates. It is possible to have only one such movable footplate on a snowboard, but it is anticipated that snowboard riders will prefer to have toe-to-heel flexibility for both feet, in which case a separate footplate mounted on a fulcrum will be attached to the snowboard for each foot.

The footplate may have any number of possible configurations, provided that the footplate includes a substantially flat portion suitable for forming a platform for the rider's boot. In a typical binding design, the footplate will have a flat portion onto which the rider's boots are removably situated, and an extension piece extending upwards from the heel-end of the flat portion, to provide support for the back of the rider's boot.

The fulcrum may conveniently be formed out of rigid or semi-rigid material, such as metal or rigid plastic, in the shape of a semi-circle. The straight edge of the semi-circle is attached to the flat underneath side of the footplate, between the heel-end and toe-end of the footplate. Thus, when the boot is strapped onto the footplate, the toe and heel can pivot around the fulcrum. When the toe moves down, the heel moves up. When pressure is applied to push the heel downward, the toe moves up. Thus, vertical flexibility is achieved by the toe-to-heel movement around the fulcrum.

The fulcrum must be free to rotate, to allow vertical motion of the footplate, but at the same time must be held in place adjacent to the top of the snowboard. The fulcrum receptacle may advantageously serve both purposes. In one embodiment, the fulcrum receptacle consists of two receptacle plates mounted on the snowboard with sufficient distance between the plates for the footplate to be placed within the two plates. Each plate is conveniently mounted at an approximately ninety degree angle to the snowboard top, and parallel to each other. Thus, a left receptacle plate extends upwards from the snowboard top adjacent to the left side of the footplate, and a right receptacle plate extends upwards from the snowboard top adjacent to the right side of the footplate. The left and right receptacle plates may be manufactured as a single U-shaped piece with a base in between, or may be two separate pieces.

In this embodiment, a fulcrum pin inserted through the left receptacle plate, the fulcrum, and the right receptacle plate allows the fulcrum to rotate while holding the fulcrum between the two receptacle plates. To accommodate the fulcrum pin, a fulcrum pin receiving hole is formed in the fulcrum, extending from side to side of the fulcrum when the fulcrum is mounted onto the footplate. Corresponding fulcrum pin receiving holes are formed in each of the receptacle plates, so that each fulcrum pin receiving hole is aligned to receive a single fulcrum pin when the pin is inserted in the fulcrum and both receptacle plates.

Although vertical motion of the footplate is advantageous for many maneuvers executed by serious snowboard riders, there are situations in which such flexibility may make the ride too difficult. In these situations, it is advantageous to have a locking means for inhibiting rotation of the footplate around the fulcrum. This locking means should be easy to engage and disengage so that the rider can conveniently stop and alternate between the flexible and rigid alternatives, as the rider encounters different snow conditions and terrains on the way down the mountain.

In a preferred embodiment, the locking mechanism may conveniently consist of a locking pin which is inserted through locking pin receiving holes formed in one or both receptacle walls, and inserted through a locking pin receptacle mounted on the bottom of the footplate. For example, a metal loop, with a hollow center with a diameter sufficient to snugly receive the locking pin, may be mounted on the bottom of the footplate between the fulcrum and the heel-end, or between the fulcrum and the toe-end. A corresponding locking pin receiving hole can be formed in either or both receptacle walls, aligned to receive the locking pin when it is inserted through the locking pin receptacle mounted on the footplate. For ease of insertion and removal of the locking pin, it is advisable to provide locking pin receiving holes in each receptacle plate, to permit the rider to insert the pin from either direction. The locking pin may conveniently have a nail-shape, so that a head on the end of the pin is too large to proceed through the locking pin receiving hole on each receptacle wall. A conventional clip inserted in a small hole on the opposite end of the locking pin can be advantageously used to hold the locking pin in place, once it has been inserted, so that the locking pin does not accidently fall out as the rider proceeds down the mountain.

As the rider applies pressure to his heel or toe to create vertical movement of the footplate, the toe-end and heel-end of the footplate will tend to hit the top of the snowboard with some force. To cushion the rider from vibrations caused by this movement, padding, such as foam rubber or similar material, may be attached to the top of the snowboard beneath the toe-end and heel-end of the footplate. Similarly, padding may be attached to the bottom of the footplate if desired.

It is useful to create a tight fit of the toe-end and heel-end of the footplate against the snowboard, to provide the rider with more control over the snowboard as pressure is applied to the toe or heel. To accommodate such a tight fit, each end of the footplate may be formed with an angled edge, such angle being suitable for maximizing the portion of the footplate which touches the top of the snowboard when that end of the footplate is pressed downward.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

2.2 BRIEF DESCRIPTION OF THE DRAWINGS

2.3 DETAILED DESCRIPTION OF THE PREFERRED EMBODIMENT

The present invention concerns a new and improved binding for snowboards and other gliding boards which allows for flexibility in toe-to-heel movement as a rider maneuvers the board, and permits the rider to elect to temporarily inhibit such movement.

In the following description, numerous specific details are set forth, in order to provide a thorough understanding of the present invention. It will be obvious, however, to one skilled in the art that the present invention may be practiced without these specific details. Some well-known methods and structure have not been set forth in order not to unnecessarily obscure the description of the present invention.

Figure 3:
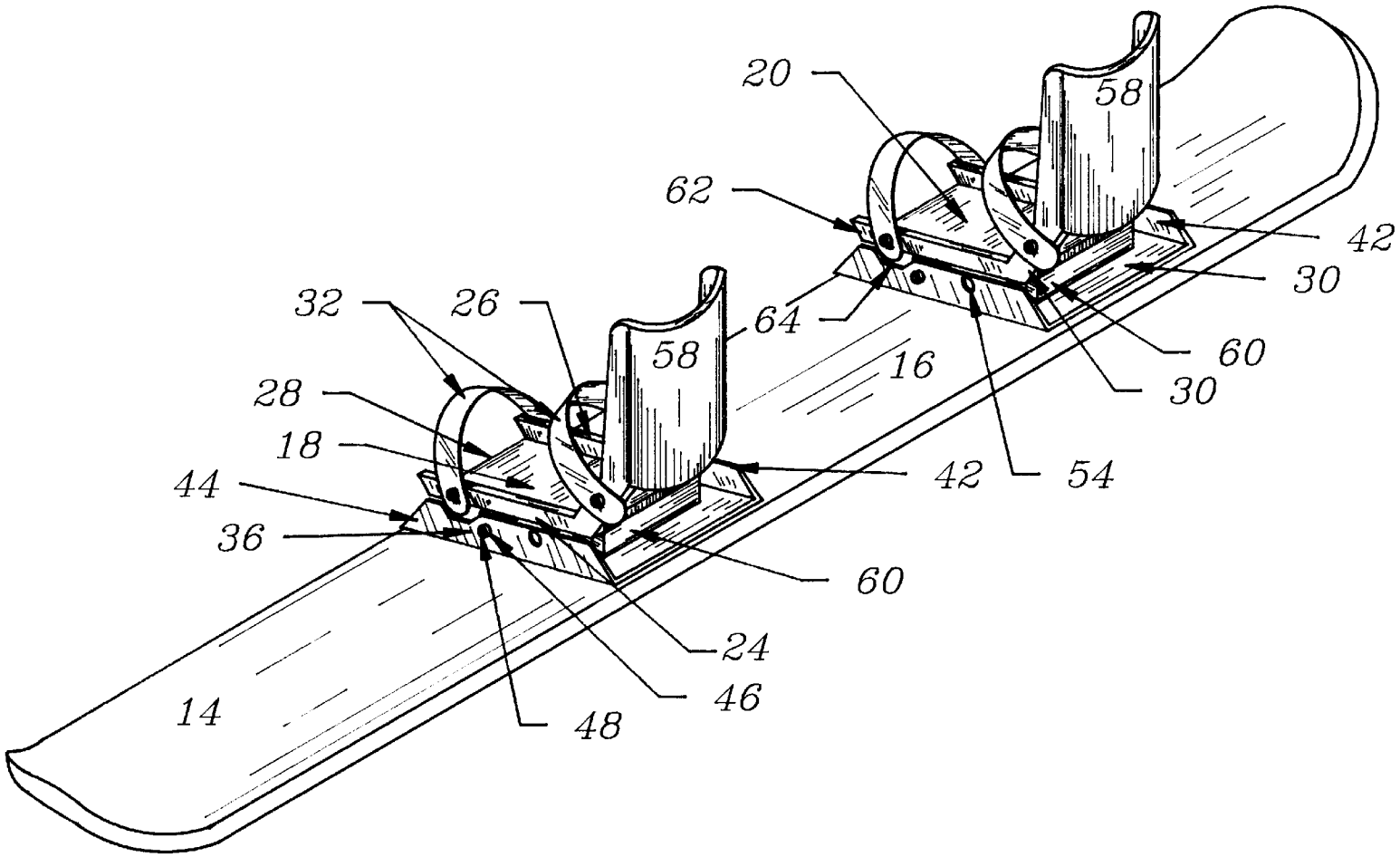
FIG. 3 is a perspective view of a snowboard with bindings according to the present invention.

The snowboard binding of the present invention can be better understood by reference to FIG. 3. A new and useful binding 10 is mounted on the top 16 of a snowboard 14 to removably hold a boot 12. The boot 12 is held in place by conventional straps 32. The novel binding 10 consists of a footplate 18, a fulcrum 34, and a fulcrum receptacle 36.

Figure 1:
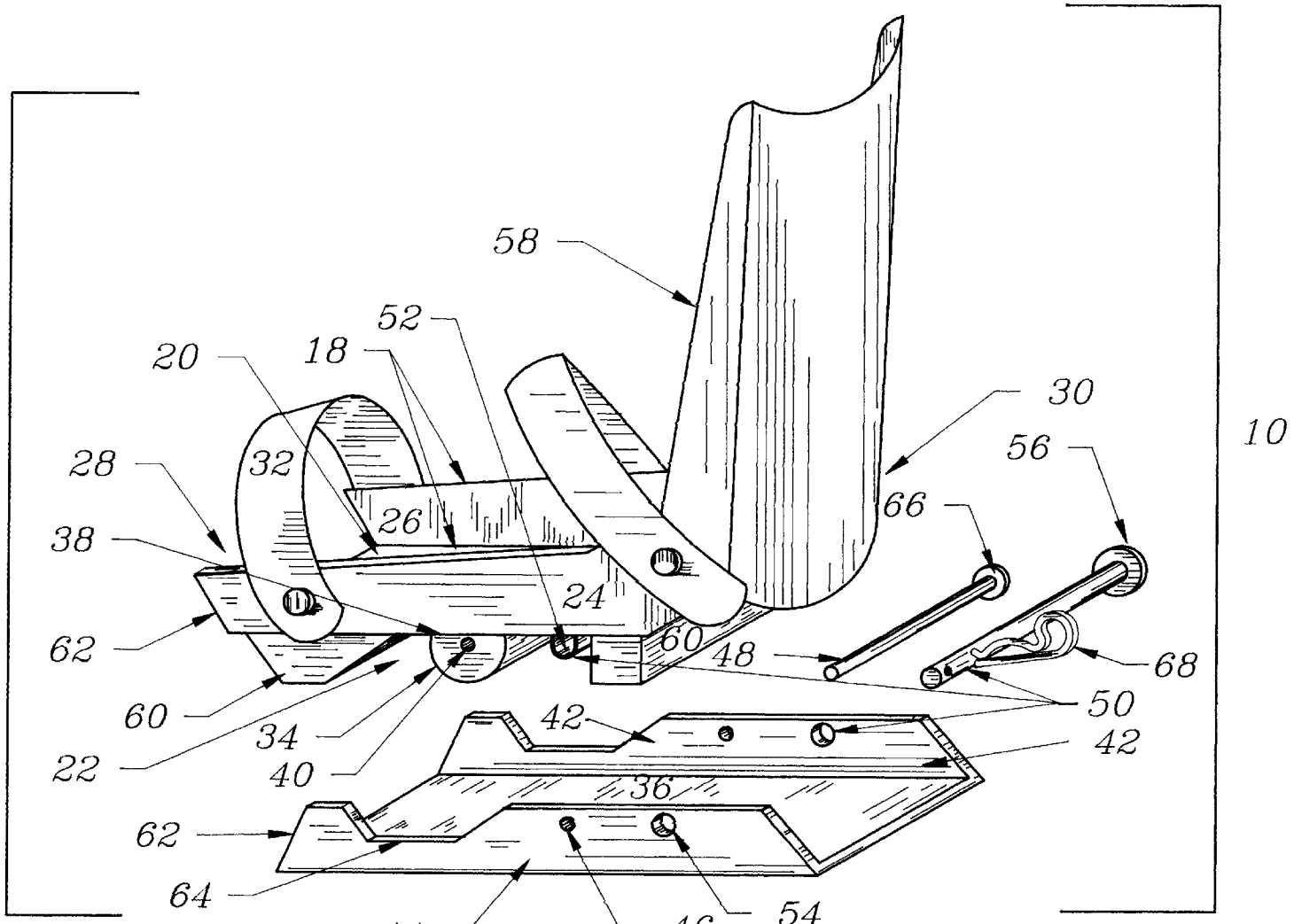
FIG. 1 is a perspective exploded view of a snowboard binding, according to the present invention.

As shown in FIG. 1, the footplate 18 has a top 20, bottom 22, left side 24, right side 26, toe-end 28, and heel-end 30. The fulcrum 34 ideally is shaped as a semi-circle, with the straight edge 38 of the semi-circle attached to the bottom 22 of the footplate 18. The fulcrum 34 is best positioned at a substantially equal distance from the left side 24 and right side 26 of the footplate 18. The position of the fulcrum 34 with respect to the heel-end 30 and toe-end 28 of the footplate 18 may be chosen based on the rider's Preference, although it is anticipated that a position equa-distant to the heel-end 30 and toe-end 28 would be advantageous for greater flexibility in toe-to-heel movement.

Figure 2:
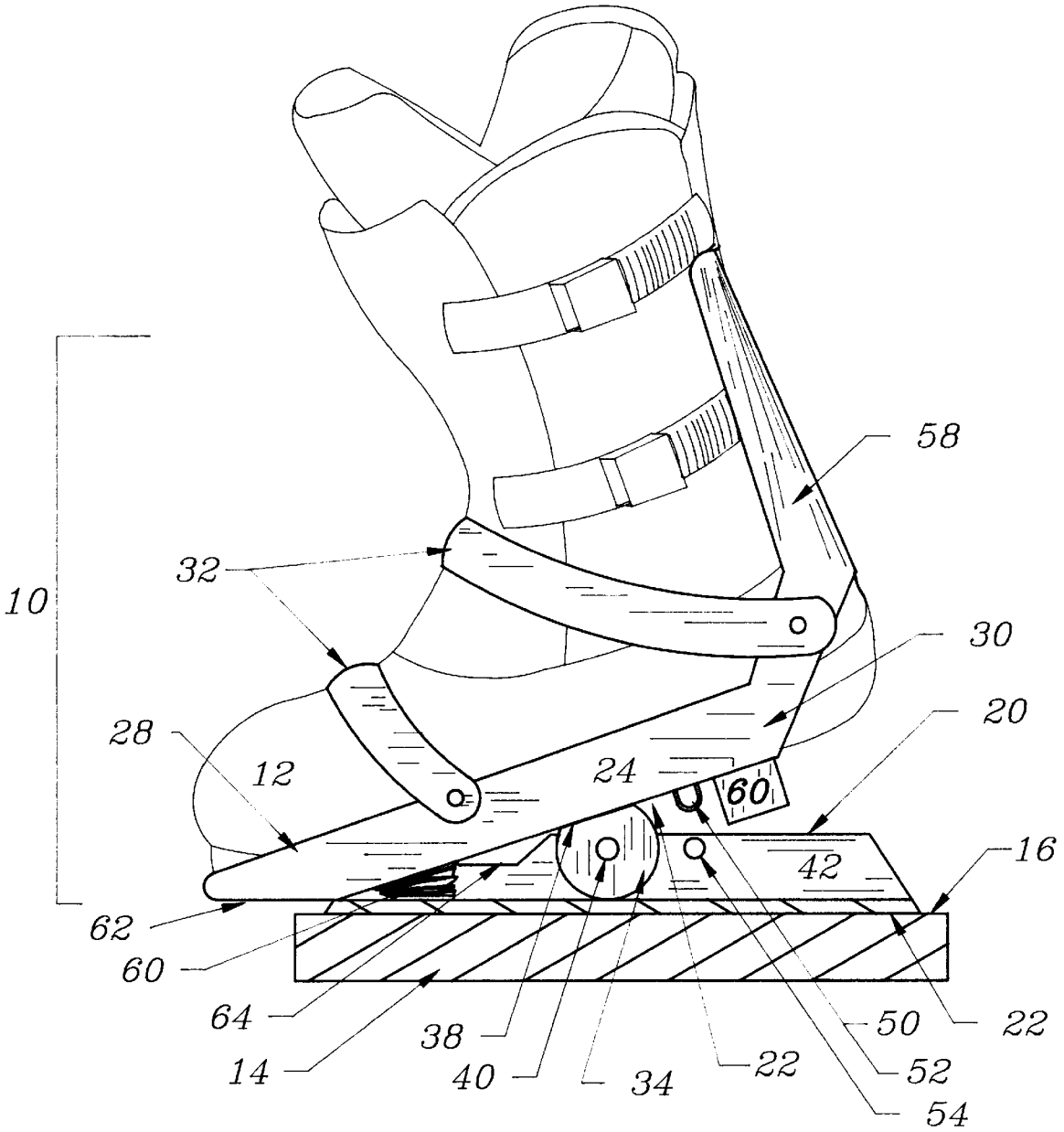
FIG. 2 is a cut-away side view of the embodiment of the present invention shown in FIG. 1.

The fulcrum 34 allows for heel-to-toe movement as the rider (not shown) pushes down on the heel or toe of the boot 12, as shown in FIG. 2. As the rider applies such pressure when riding the snowboard 14 down a mountain (not shown), the footplate 18 is pivoted around the fulcrum 34. The rider will be able to exert more control over the snowboard 14 if the heel-end 30 or toe-end 28 of the footplate 18 engages the top 16 of the snowboard 14, so it is advantageous to provide angled ends 62 on the footplate 18. To maximize the portion of the footplate 18 which can contact the snowboard 14, the angled end 62 of the footplate 18 should form an obtuse angle with the top 16 of the snowboard, when the snowboard 14 and footplate 18 are parallel, as best shown in FIG. 2.

A number of possible configurations for the footplate 18 are possible, and it is expected that footplate designs already known in the prior art will be utilized. For the specialized binding 10 it is imperative that a portion of the footplate 18, on which the boot 12 rests, be flat to form a suitable platform for the boot 12. It is possible to have a footplate extension 58 which extends upwards from the heel-end 30 of the footplate 18, to form a back support for the boot 12, as shown in FIG. 2.

Figure 4:
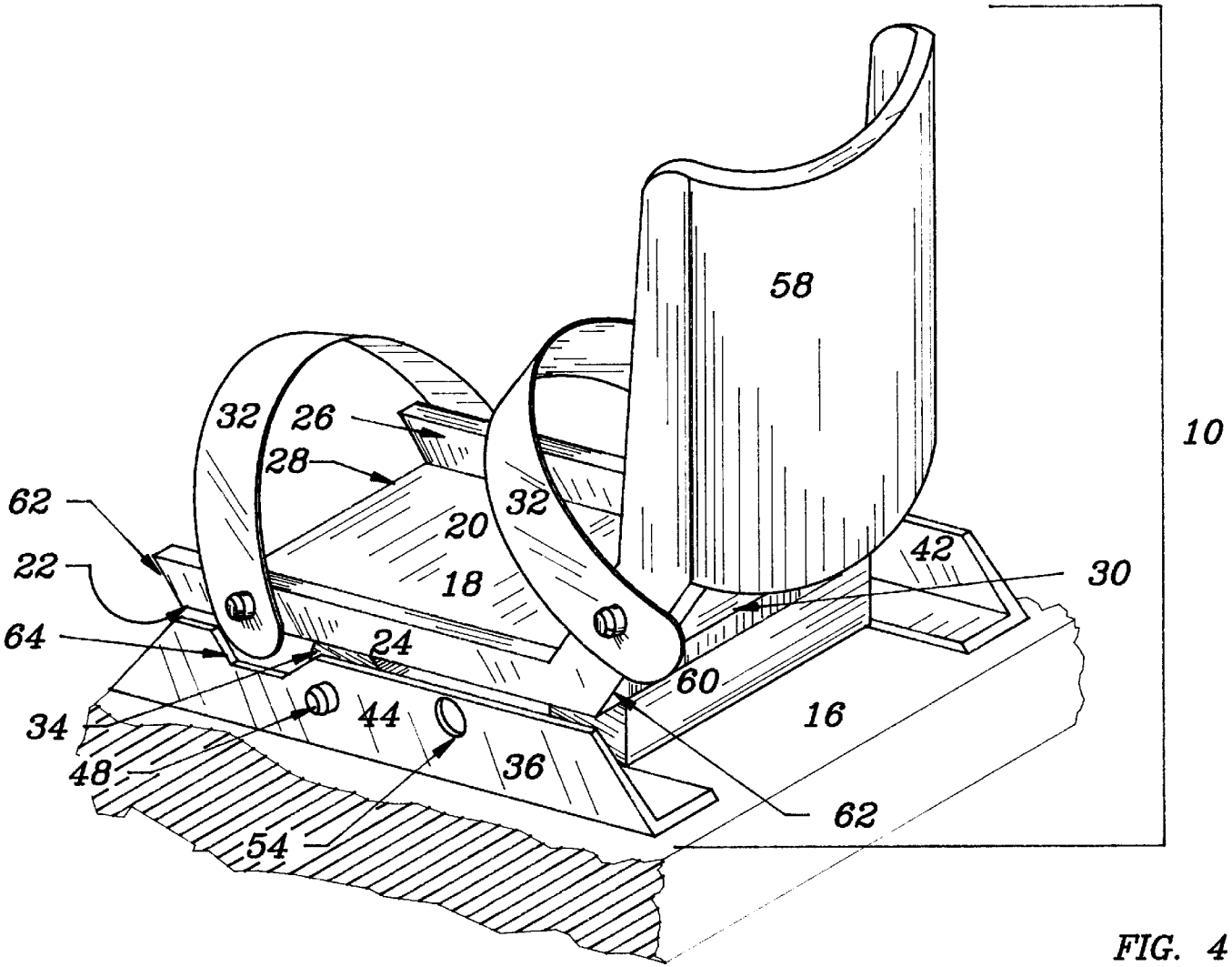
FIG. 4 is a back perspective view of a snowboard binding according to the present invention, shown mounted on a portion of a snowboard.

As shown in FIG. 1, the fulcrum receptacle 36 may conveniently consist of a right receptacle plate 42, left receptacle plate 44, and a fulcrum pin 48. Each receptacle plate 42,44 is mounted on the snowboard top 16, extending upwards at a substantially right angle to the snowboard top 16. The plates 42,44 are mounted at a sufficient distance from each other to allow the footplate 18 to rest in between the two plates 42,44. In this manner, the plates 42,44 do not interfere with the vertical motion of the footplate 18. If the plates 42,44 are so close to the footplate 18 as to interfere with a strap 32 protruding from the footplate 18, it is advantageous to cut a notch 64 in the receptacle plate 42,44 to avoid contact with the strap 32, as shown in FIG. 4.

A fulcrum pin receiving hole 40 is formed from side-to-side in the fulcrum, as best shown in FIG. 1. This fulcrum pin receiving hole 40 is conveniently aligned with corresponding fulcrum pin receiving holes 46 on one or both receptacle plates 42,44. Thus, the fulcrum pin 48 can be inserted through each fulcrum pin receiving hole 40,46 to hold the fulcrum 34 between the receptacle plates 42,44, while still permitting rotation of the fulcrum 34. A conventional clip can be used to lock the fulcrum pin 48 in place, by inserting that clip in one end of the fulcrum pin 48 after it is inserted through the fulcrum pin receiving holes 40,46. Ideally, the fulcrum pin 48 will have a head 66 which is a diameter sufficient to inhibit entry of the head 66 of the fulcrum pin 48 into a fulcrum pin receiving hole 46.

A locking mechanism 50 may be advantageously included in the specialized binding 10 to permit the rider to temporarily inhibit toe-to-heel motion. As shown in FIG. 1, the locking means 50 may consist of a locking pin 56 inserted through a locking pin receiving hole 54 in one or both receptacle plates 42,44, and inserted through a locking pin receptacle 52 attached to the bottom 22 of the footplate 18. The locking pin 56 can easily be manually inserted or removed, and can be locked in place by a conventional mechanism such as a clip 68 inserted through a hole at the end of the locking pin 56.

The vertical flexibility permitted by this specialized binding 10 may result in significant jarring of the rider. As a result, it may be useful to provide padding, such as foam rubber or similar material, between the footplate 18 and the snowboard top 16. Padding has the additional benefit of keeping snow from being trapped under the footplate, which can hinder movement. Such padding 60 can be attached to the bottom 22 of the footplate 18, as shown in FIGS. 1 and 2, or to the top 16 of the snowboard 14, as shown in FIG. 4.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention.

I claim:

1. A binding for removably holding a boot of a snowboard rider on top of a snowboard, the binding having a longitudinal axis which extends at an angle to a longitudinal axis of the snowboard when mounted thereon, with one binding provided for each boot of the snowboard rider, the binding comprising:

a footplate having a toe-end, a heel-end, a substantially planar top surface, a substantially bottom surface, and a plurality of straps mounted on the footplate for removably securing the boot to the footplate, a bottom surface of the boot adapted to be supported by the top surface of the footplate when secured thereto, a fulcrum having a cylindrical shape with a planar upper surface extending along a longitudinal axis of the fulcrum, the planar upper surface being fixedly attached to the planar bottom surface of the footplate with the longitudinal axis of the fulcrum extending transverse to the longitudinal axis of the binding and positioned between the toe-end and the heel-end of the footplate, and a pin receiving hole formed therein extending along the longitudinal axis of the fulcrum, a fulcrum receptacle having a bottom plate attached to a top surface of the snowboard, a pair of side plates extendng upwardly from laterally opposed sides of the bottom plate, the pair of side plates having aligned holes formed therein, and a pin extending through the aligned holes and the pin receiving hole for rotatably mounting the fulcrum between the pair of side plates with a lower surface of the fulcrum in engagement with the bottom plate for permitting pivotal movement of the footplate about the fulcrum and vertical movement of the toe-end and the heel-end of the footplate relative to the bottom plate, and a first resilient member positioned between the toe-end of the footplate and the bottom plate, and a second resilient member positioned between the heel-end of the footplate and the bottom plate, for providing dampening of pivotal movement of the footplate about the fulcrum.

2. A binding as described in claim 1, further comprising locking means for inhibiting pivotal movement of said footplate about said fulcrum.

3. A binding as described in claim 2, said locking means comprising:

a locking pin receptacle mounted on the bottom surface of said footplate, at least one of said side plates having a locking pin receiving hole formed therein, wherein said locking pin receptacle is aligned adjacent to said locking pin receiving hole when said footplate is in a desired position with respect to said bottom plate, and a locking pin removably inserted in said locking pin receptacle and said locking pin receiving hole.

4. A binding as described in claim 1, further comprising a footplate extension extending upwardly at a substantially right angle from said heel-end of said footplate away from said bottom plate.

5. A binding as described in claim 1, wherein said toe-end of said footplate has an edge which forms an obtuse angle with respect to the bottom surface of said footplate.

6. A binding as described in claim 1, wherein said heel-end of said footplate has an edge which forms an obtuse angle with respect to the bottom surface of said footplate.

7. A method of removably holding a boot of a snowboard rider on top of a snowboard, said method comprising securing the boot to a binding having a longitudinal axis which extends at an angle to a longitudinal axis of the snowboard when mounted thereon, with one binding provided for each boot of the snowboard rider, said binding having a footplate with a toe-end, a heel-end, a substantially planar top surface, a substantially planar bottom surface, and a plurality of straps mounted on the footplate for removably securing the boot to the footplate, a bottom surface of the boot adapted to be supported by the top surface of the footplate when secured thereto, said binding further having a fulcrum with a cylindrical shape and a planar upper surface extending along a longitudinal axis of the fulcrum, the planar upper surface being fixedly attached to the planar bottom surface of the footplate with the longitudinal axis of the fulcrum extending transverse to the longitudinal axis of the binding and positioned between the toe-end and the heel-end of the footpate, and a pin receiving hole formed therein extending along the longitudinal axis of the fulcrum, said binding further having a fulcrum receptacle with a bottom plate attached to a top surface of the snowboard, a pair of side plates extending upwardly from laterally opposed sides of the bottom plate, the pair of side plates having aligned holes formed therein, and a pin extending through the aligned holes and the pin receiving hole for rotatably mounting the fulcrum between the pair of side plates with a lower surface of the fulcrum in engagement with the bottom plate for permitting pivotal movement of the footplate about the fulcrum and vertical movement of the toe-end and the heel-end of the footplate relative to the bottom plate, and said binding further having a first resilient member positioned between the toe-end of the footplate and the bottom plate, and a second resilient member positioned between the heel-end of the footplate and the bottom plate, for providing dampening of pivotal movement of the footplate about the fulcrum.

* * * * *